US006530245B1

(12) United States Patent
Kawabata et al.

(10) Patent No.: US 6,530,245 B1
(45) Date of Patent: Mar. 11, 2003

(54) DRUM TYPE WASHING MACHINE WITH DRYING FUNCTION

(75) Inventors: Shinichiro Kawabata, Seto (JP); Masumi Ito, Seto (JP); Kiyomi Sasano, Ichinomiya (JP); Fumitaka Yamazaki, Asaka (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 195 days.

(21) Appl. No.: 09/692,149

(22) Filed: Oct. 20, 2000

(30) Foreign Application Priority Data

Oct. 21, 1999 (JP) ..... 11-299479

(51) Int. Cl.[7] ..... D06F 25/00

(52) U.S. Cl. ..... 68/20; 68/19.2; 68/24; 68/58; 68/140

(58) Field of Search ..... 68/3 R, 19.2, 20, 68/24, 58, 140

(56) References Cited

U.S. PATENT DOCUMENTS 1,799,649 A * 4/1931 Schenck
2,434,476 A * 1/1948 Wales
2,892,335 A * 6/1959 Gray, Jr.
2,957,330 A * 10/1960 Cline
3,038,324 A * 6/1962 Hubbard
3,108,464 A * 10/1963 Behrens
3,116,916 A * 1/1964 Sexton
3,116,984 A * 1/1964 Decatur
3,121,000 A * 2/1964 Hubbard
4,154,003 A * 5/1979 Muller
5,074,131 A * 12/1991 Hirose et al.
5,272,781 A * 12/1993 Bastin et al.
6,279,357 B1 * 8/2001 Didlick et al.

FOREIGN PATENT DOCUMENTS

JP 64-32893 * 2/1989
JP 1-249093 * 10/1989
JP 1-317482 * 12/1989
JP 3-45297 * 2/1991

* cited by examiner

*Primary Examiner*—Frankie L. Stinson
(74) *Attorney, Agent, or Firm*—Pillsbury Winthrop LLP

(57) ABSTRACT

A drum type washing machine with a drying function includes an outer cabinet, a water tub mounted in the outer cabinet and having a wall, a generally drum-shaped rotating tub rotatably mounted in the water tub, and a drying unit for drying laundry accommodated in the rotating tub. The drying unit includes a heat exchanger having a duct disposed in it so that air flows through the duct. The duct includes a part comprising the wall of the water tub.

8 Claims, 5 Drawing Sheets

DRUM TYPE WASHING MACHINE WITH DRYING FUNCTION

BACKGROUND OF THE INVENTION

1. Field of the Invention

This invention relates to a drum type washing machine with a drying function which comprises a rotating tub in which laundry is washed and dried, and more particularly to an improvement in the construction of a heat exchanger employed in such a drum type washing machine.

2. Description of the Prior Art

FIG. 5 illustrates one of conventional drum type washing machines. As shown, the washing machine comprises an outer cabinet 1, a drum-shaped water tub 2 elastically mounted on a plurality of suspension mechanisms 3 in the cabinet 1, and a drum-shaped rotating tub 4 rotatably mounted in the water tub 2. A front wall of the cabinet 1 has an access opening 5 through which laundry is put into and taken out of the rotating tub 4. A door 9 is mounted on the front wall of the cabinet 1 so as to open and close the opening 5. The water tub 2 and the rotating tub 4 nave openings 6 and 7 formed in front walls respectively. The access opening 5 is water-tightly connected by bellows 8 to the opening 6 of the water tub 2. An electric heater 17 and a blower 15 are disposed over the right-hand top of the water tub 2 so that the blower is positioned in the rear of the heater. The heater 17 comprises a heating element 16 accommodated in a duct 17*a*. The duct 17*a* has a rear end connected to a discharge side of the blower 15. The water tub 2 has a hot-air outlet 6*a* formed around the opening 6. The duct 17*a* has a front end connected via a duct 18 to the hot-air outlet 6*a*.

An electric motor 11 of the outer rotor type is mounted on a generally central outside face of a rear panel 2*a* of the water tub 2. The motor 11 includes a rotational shaft 11*a* extending through a hole formed in the rear panel 2*a* to be fixed to the rear of the rotating tub 4. A heat exchanger 12 is provided at the left hand of the motor 11 in the rear of the water tub 2 as viewed at the rear of the machine. The heat exchanger 12 comprises a duct 18 fixed to the outside face of the rear panel 2*a* and having a rectangular section as shown in FIG. 6. The duct 18 has a lower end connected to a hot-air return port 13 formed in a lower portion of the water tub 2. The duct 18 further has an air outlet 14 formed in an upper end thereof and connected to a suction side of the blower 15. The blower 15, heater 17 and heat exchanger 12 constitute drying means for drying laundry.

Upon start of a drying operation, the blower 15 and the heater 17 are energized and the rotating tub 4 is rotated at low speeds alternately repeatedly in the normal and reverse directions. Further, a water supply (not shown) supplies water into the duct 18 of the heat exchanger 12. Moist air in the rotating tub 4 is then sucked into the duct 18 through holes 10 and the hot-air return port 13. The air sucked into the duct 18 is circulated through the air outlet 14, blower 15, duct 17*a* of the heater 17, duct 18, hot-air outlet 6*a* and the water tub 2 and accordingly the rotating tub 4 sequentially in this order. The air in the rotating tub 4 is warmed and dehumidified as the result of the aforesaid circulation, whereupon the laundry in the rotating tub 4 is dried.

In the above-described washing machine, the duct 18 of the heat exchanger 12 is discrete from the water tub 2. This results in a small space between the duct 18 and the water tub 2. The space increases a space defined between the rear panel 2*a* of the water tub 2 and the outer cabinet 1 for disposition of the heat exchanger 12. More specifically, a minimum distance, (A+2t+C), is required between the rear panel 2*a* of the water tub 2 and the outer cabinet 1 where A is an inside depth of the interior of the duct 18, t is a thickness of the duct 18 and C is a distance between the duct 18 and the rear panel of the water tub 2, as shown in FIG. 6. Further, a reduction in an amount of material for each component has been considered for the purpose of reduction in the manufacturing cost. Concerning the heat exchanger 12, a reduction in an amount of material for the duct 18 has been desired.

SUMMARY OF THE INVENTION

Therefore, an object of the present invention is to provide a drum type washing machine with a drying function which can reduce the space for disposition of the heat exchanger and which can reduce an amount of material for the duct of the heat exchanger.

The present invention provides a drum type washing machine with a drying function, comprising an outer cabinet, a water tub provided in the outer cabinet and having a rear wall, a generally drum-shaped rotating tub rotatably mounted in the water tub, a driving mechanism provided on a generally central outside face of the rear wall of the water tub for driving the rotating tub, and a drying unit provided for drying laundry accommodated in the rotating tub and including a heat exchanger disposed on the rear wall of the water tub so as to be positioned around the driving mechanism, the heat exchanger having a duct provided therein so that air flows therethrough, the duct including a part comprising the rear wall of the water tub.

According to the above-described construction, the duct includes a part comprising the rear wall of the water tub. Accordingly, since the heat exchanger is incorporated with the water tub, the mounting space for the heat exchanger can be reduced. Further, since the rear wall of the water tub forms-a part of the duct, an amount of material for the duct can be reduced.

In a first preferred form the washing machine further comprises, a cover mounted on an outside face of the rear wall of the water tub, and the duct comprises the cover as well as the rear wall of the water tub. The cover can easily be detached from and re-attached to the water tub when the heat exchanger is repaired.

In a second preferred form the washing machine further comprises, a cover mounted on an inside face of the rear wall of the water tub, and the duct comprises the, cover as well as the rear wall of the water tub. Even when water in the duct leaks out through a junction of the cover and the rear wall of the water tub, it is once reserved in the water tub to be discharged through a drain hole. Consequently, since a strict countermeasure need not be taken for water leakage "through the junction, the manufacturing cost can be reduced.

In a third preferred form, the duct is mounted on the rear wall of the water tub so as to extend along a peripheral edge of the rear wall. A flow passage of air flowing through the duct can be lengthened by increasing the length of the duct. Consequently, the dehumidifying performance of the heat exchanger can be improved.

In a fourth preferred form, the wall of the water tub comprises a rear wall, the water tub includes a number of ribs mounted on the rear wall thereof to reinforce the rear wall, and the rear wall has one of two sides on which the heat exchanger is mounted and the other side on which the ribs are mounted so as to correspond to the heat exchanger.

Consequently, the portion of the rear wall on which the heat exchanger is mounted can sufficiently be reinforced by the ribs as well as its portion on which the heat exchanger is not mounted. Moreover, an area of the flow passage in the duct can be prevented from being decreased as the result of provision of the ribs.

In a fifth preferred form the washing machine further comprises, a cover mounted on the rear wall of the water tub, and the duct comprises the cover as well as the rear wall of the water tub. In this construction, the duct is made of a material having a smaller sniffiness than the rear wall of the water tub. This construction permits the cover to be deformed in compliance with the configuration of the rear wall of the water tub when the cover is mounted on the rear wall. Consequently, a gap can be prevented from being defined between the cover and the wall.

In a sixth preferred form, the rear wall of the water tub is made of a synthetic resin. The synthetic resin has a better heat-insulating. Performance than metals. Accordingly, even when a part of the duct comprises the rear wall of the water tub, heat in the water tub is difficult to be transferred to the duct. Consequently, the heat exchange efficiency can be improved.

BRIEF DESCRIPTION OF THE DRAWINGS

Other objects, features and advantages of the present invention will become clear upon reviewing the following description of the preferred embodiments, made with reference to the accompanying drawings, in which.

DETAILED DESCRIPTION OF THE PREFERRED EMBODIMENTS

Figure 1:
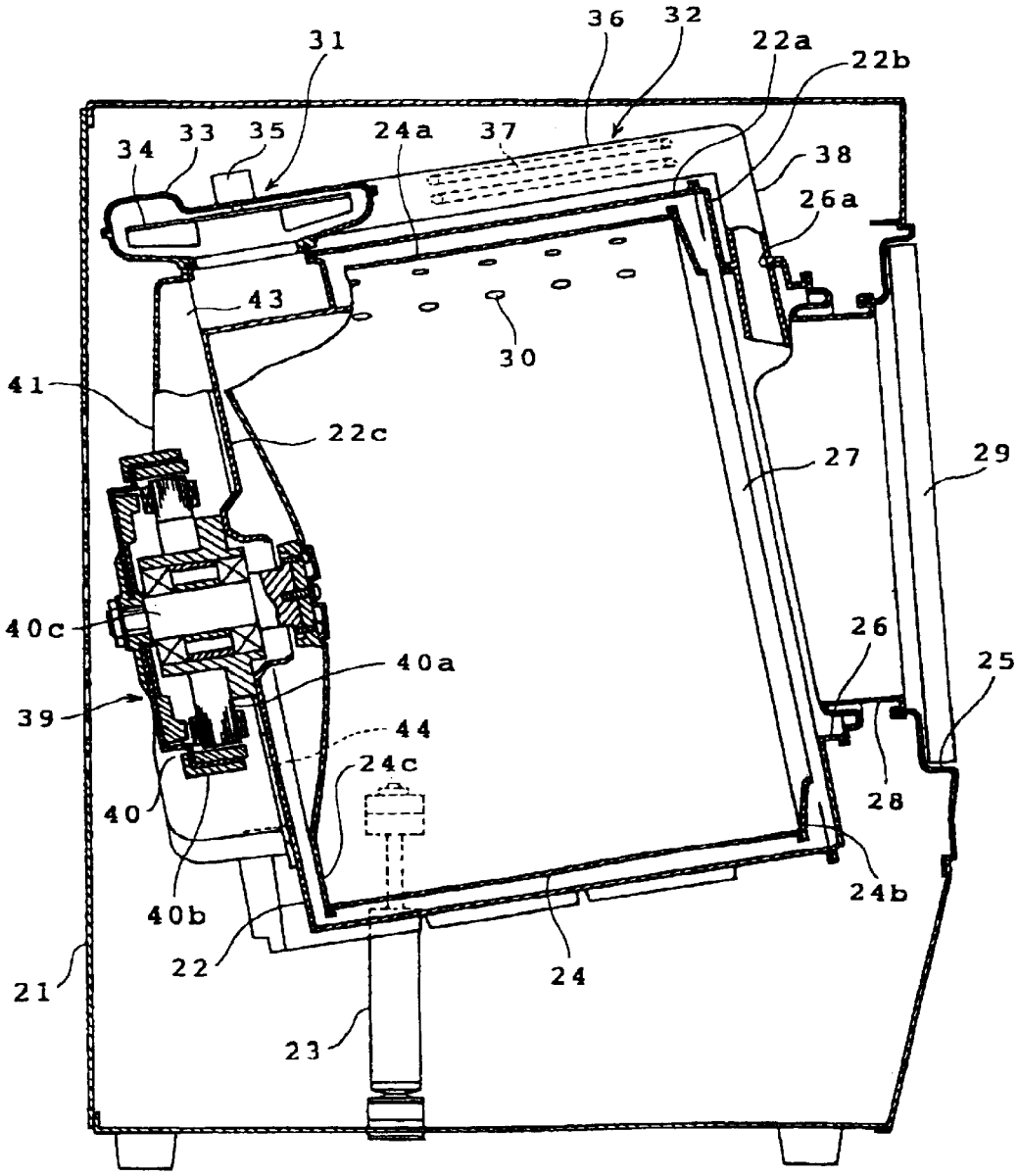
FIG. 1 is a longitudinally sectional side view of the drum type washing machine of one embodiment in accordance with the present invention.
Figure 2:
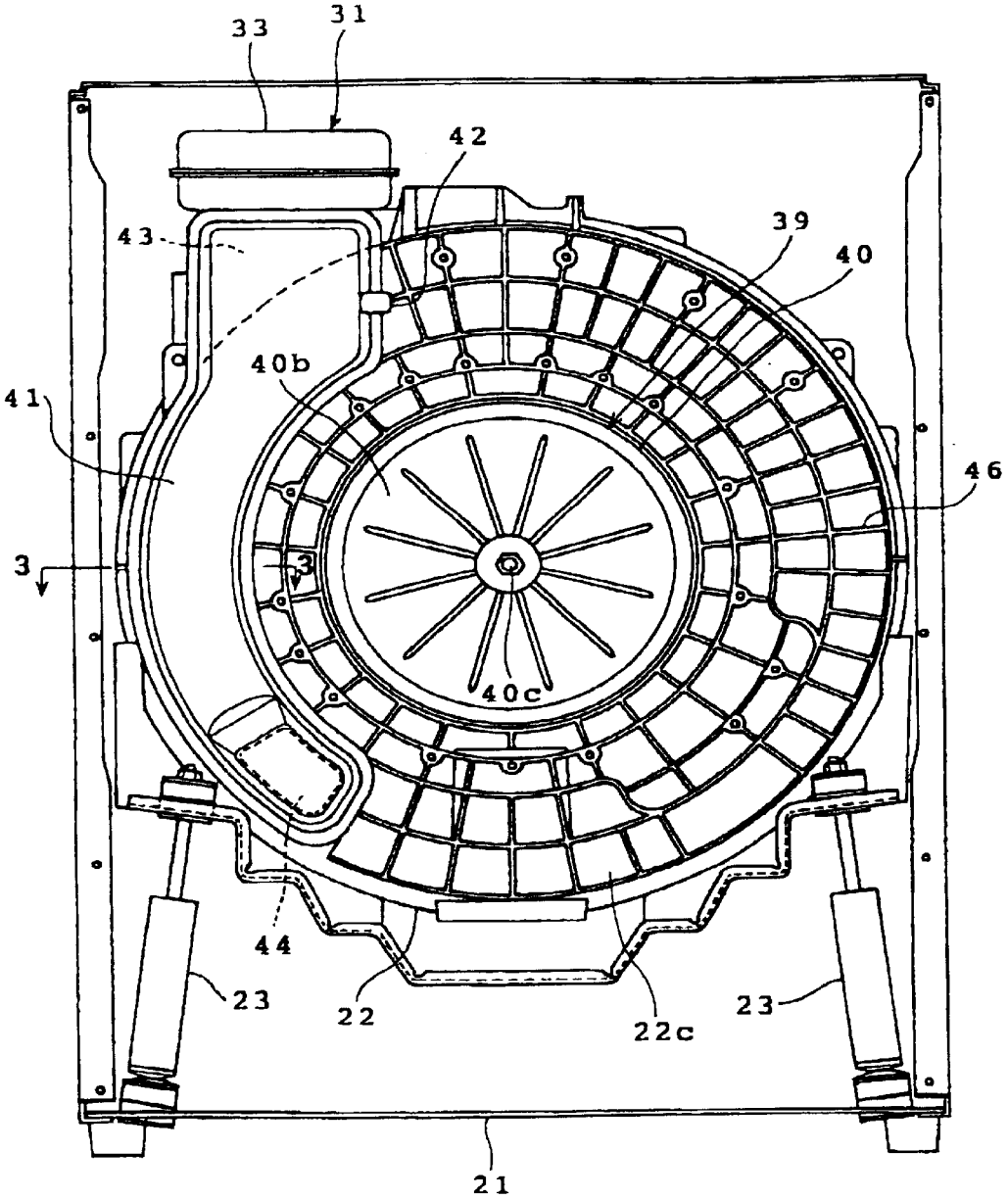
FIG. 2 is a rear view of the washing machine with a rear panel of an outer cabinet being eliminated.
Figure 3:
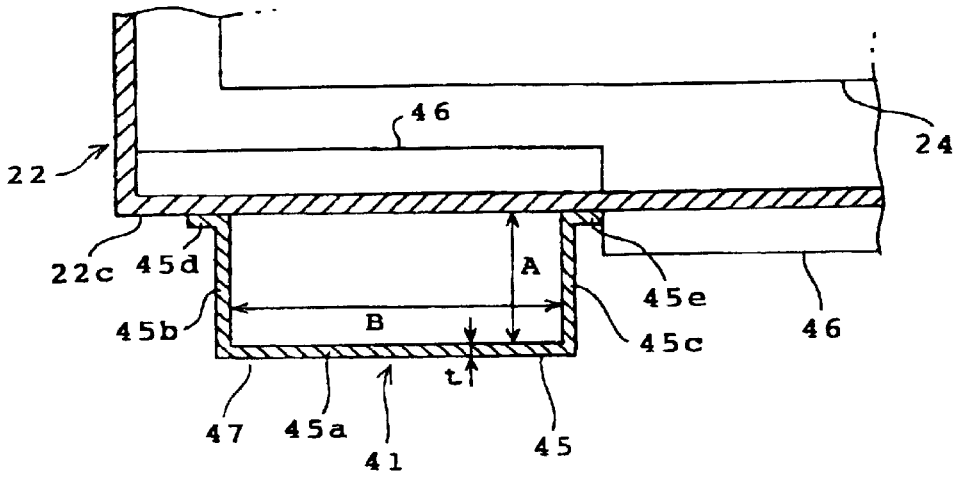
FIG. 3 is a longitudinal section taken along line 3—3 in FIG. 2.

A first embodiment of the present invention will be described with reference to FIGS. 1 to 3. Referring to FIGS. 1 and 2, an overall construction of the drum type washing machine of the first embodiment is shown. The washing machine comprises a generally rectangular box-shaped outer cabinet 21. The cabinet 21 has a front wall formed with an access opening 25 through which laundry is put into and taken out of a rotating tub 24. A door 29 is mounted on the front wall of the cabinet 21 so as to open and close the access opening 25. A generally drum-shaped water tub 22 is disposed in the cabinet 21 so that a rear portion thereof is downwardly inclined. The water tub 22 is elastically supported on two pairs of suspension mechanisms 23. The water tub 22 includes a circumferential wall 22*a*, a front panel 22*b* and a rear panel 22*c* all of which constitute a wall in the invention. The front panel 22*b* has a generally circular opening 26 water-tightly connected by an elastic member such as rubber bellows 28 to the access opening 25 of the cabinet 1.

The generally drum-shaped rotating tub 24 is rotatably mounted in the water tub 22. The rotating tub 24 is also disposed so that a rear portion thereof is downwardly inclined. The rotating tub 24 serves as a dehydrating tub, a washing tub and a drying tub and includes a circumferential wall 24*a*, a front panel 24*b* and a rear panel 24*c*. The circumferential wall 24*a* has a number of holes 30 through which both air and water flow. The front panel 24*b* has a circular opening 27 and the rear panel 24*c* has a number of holes (not shown). An electric motor 40 serving as a driving mechanism is mounted on a generally central outside face of the rear panel 22*c* of the water tub 22. The motor 40 is of the outer rotor type in which a rotor 40*b* is disposed around a stator 40*a*. The motor 40 includes a rotational shaft 40*c* extending through a hole formed in the rear panel 22*c* to be secured to a generally central portion of the rear panel 24*c* of the rotating tub 24. The rotating tub 24 is thus rotated directly by the motor 40.

A blower 31 and an electric heater 32 are disposed over the right-hand top of the water tub 22 so that the blower 31 is positioned in the rear of the heater 32. The blower 31 comprises a casing 33, a blade 34 accommodated in the casing and an electric motor 35 mounted on an outside face of the casing 33. The blade 34 is driven by the motor 35. The heater 32 comprises a duct-shaped casing 36 and a heating element 37 accommodated in the casing 36. The casing 36 has a rear end connected to a discharge side of the casing 33 of the blower 31. The water tub 22 has a hot-air outlet 26*a* formed around the opening 26. The casing 36 of the heater 32 is connected via a duct 38 to the hot-air outlet 26*a*.

A heat exchanger 41 is disposed on an outside face of the rear panel 22*c* of the water tub 22 in the cabinet 1. The heat exchanger 41 comprises a duct 47 formed by fixing a cover 45 to a portion of the rear panel 22*c* at the left hand of the motor 40 as viewed in FIG. 2. The cover 45 is made of a material having a smaller stiffness than the water tub 22. More specifically, the water tub 22 is made of polypropylene containing glass fiber, whereas the cover 45 is made of polypropylene which does not contain glass fiber. The cover 45 is mounted on the rear panel 22*c* so as to extend along a peripheral edge of the rear panel 22*c* in the embodiment. The cover 45 has the shape of an arc formed about the center of rotation of the rotating tub 24, namely, the center of the rotational shaft 40*c* of the motor 40. The cover 45 comprises a rear wall 45*a* and left-hand and right-hand side walls 45*b* and 45*c* and has a generally C-shaped section. The side walls 45*b* and 45*c* have front ends with integrally formed, outwardly extending flanges 45*d* and 45*e* respectively as shown in FIG. 3. The flanges 45*d* and 45*e* are screwed to the outside face of the rear panel 22*c* of the water tub 22 with packing or sealing members being interposed therebetween, whereupon the cover 45 is fixed to the rear panel 22*c*. The cover 45 has a thickness, length, inside depth and inside width which are set to be equal to those of the hereinbefore described conventional washing machine. As a result, a rectangular flow passage defined in the duct 47 of the heat exchanger 41 has substantially the same area as the duct 12*a* of the heat exchanger 12 of the conventional washing machine.

The cover 45 has a water inlet 42 formed in an upper portion thereof as shown in FIG. 2. The water inlet 42 is connected to a water supply (not shown), Further, the upper end of the cover 45 is connected to the suction side of the casing 33 of the blower 31. The connected portion serves as an air outlet 43. The rear panel 22*c* of the water tub 22 has a hot-air return port 44 formed in a lower portion thereof corresponding to a lower portion of the cover 45. The blower 31, heater 32 and heat exchanger 41 constitute a dryer 39 serving as a drying unit for drying laundry in the rotating tub 24.

A number of reinforcing ribs 46 are provided on the rear panel 22*c* of the water tub 22. More specifically, the ribs 46 are mounted on a portion of the inside face of the rear panel 22*c* corresponding to one portion of the outside face thereof on which the heat exchanger 41 is disposed. The ribs 46 are further mounted on the other portion of the outside face of the rear panel 22*c* on which the heat exchanger 41 is not disposed. Accordingly, the area of the flow passage of the heat exchanger 41 can be prevented from being reduced by the ribs 46.

The above-described washing machine automatically carries out a washing/drying course in which a washing operation and a drying operation are automatically carried out, a washing course in which only the washing course is automatically carried out, and a drying course in which only the drying operation is automatically carried out. In the drying operation, the motor 35 of the dryer 39 is driven to rotate the blade 34 and the heater 32 is energized so that the heating element 37 generates heat. At this time, the water supply (not shown) supplies water through the water inlet 42 into the duct 47. Further, the rotating tub 24 is rotated at low speeds alternately repeatedly in the normal and reverse directions. As a result, moist air in the rotating tub 24 is sucked through the holes 30 and the hot-air return port 44 into the duct 47 of the heat exchanger 41. The air sucked into the duct 47 flows through the air outlet 43 into the casing 33 of the blower 31 while being condensed and dehumidified. The air then flows through the casing 36 of the heater 32, duct 38 and hot-air outlet 26*a* into the water tub 22 and accordingly the rotating tub 24 sequentially in the order. The air in the rotating tub 24 is warmed and dehumidified as the result of the aforesaid circulation, whereupon the laundry in the rotating tub 24 is dried.

According to the foregoing embodiment, the hot-air outlet 26*a* is formed in the upper front of the water tub 22 and the hot-air return port 44 is formed in the lower rear of the water tub 22. This increases the length of the flow passage for the hot air in the rotating tub 24. Consequently, the drying efficiency can be improved since an area of the laundry in which the laundry is brought into contact with hot air in the rotating tub 24 is increased.

The duct 47 of the heat exchanger 41 includes the cover 45 fixed to the rear panel 22*c* of the water tub 22. More specifically, a part of the duct 47 comprises the rear panel 22*c*. Consequently, the washing machine can reduce the distance between the rear of the water tub 22 and the rear of the heat exchanger 41 at least by the thickness t of the cover 45 while ensuring the same flow passage area as the heat exchanger 12 of the conventional washing machine. Further, since the part of the duct 47 comprises the rear panel 22*c*, an amount of the material for the duct 47 can be reduced. In the heater exchanger 12 of the conventional washing machine, the duct 18 requires an amount of the material expressed by $\{2\times(A+B)\times L\}$. On the other hand, the duct 47 of the heat exchanger 41 requires an amount of the material expressed by $\{(2A+B)\times L\}$. Thus, the amount of the material for the duct 47 in the foregoing embodiment is smaller by $(B\times L)$ than that of the material for the duct 18 in the conventional washing machine. Further, the cover mounted on the rear panel 22*c* constitutes the heat exchanger 41 as described above. Accordingly, the cover 45 can easily be detached from and re-attached to the water tub 22 for the purpose of repair or inspection.

The motor 40 is mounted on the outside face of the rear panel 22*c* of the water tub 22. The outside face of the rear panel 22*c* then needs to be spaced away from the rear of the cabinet 21 by an axial dimension of the motor 40. As a result, a large space is defined between the rear of the cabinet 21 and a portion of the rear panel 22*c* excluding the motor 40. In view of this space, the cover 45 is fixed to the outside face of the rear panel 22*c* around the motor 40. Consequently, an increase in the size of the cabinet 21 can be prevented even though the duct 47 is formed by utilizing the rear panel 22*c*.

The cover 45 has the shape of the arc formed about the center of the rotational shaft 40*c* of the motor 40. The cover 45 is disposed so as to extend along the peripheral edge of the rear panel 22*c*. Consequently, the duct 47 can be rendered long enough to obtain a sufficient dehumidifying performance. Further, the water tub is generally made of a metal. In the foregoing embodiment, however, the water tub 22 is made of the synthetic resin. Since the synthetic resin has a higher heat insulation performance than the metals, heat in the water tub 22 is rendered less transferable to the duct 47. Consequently, the dehumidifying performance can be prevented from being reduced even though the rear panel 22*c* of the water tub 22 constitutes the part of the duct 47.

The cover 45 is made of the material having a smaller stiffness than therear panel 22*c*. Accordingly, the flanges 45*d* and 45*e* are pliably deformed in compliance with the configuration of the rear panel 22*c* when screwed to it. Consequently, a gap can be prevented from being formed between the cover 45 and the rear panel 22*c*.

Figure 4:
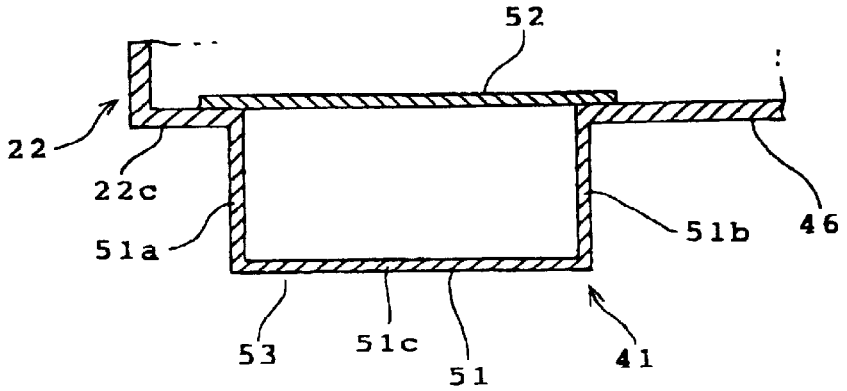
FIG. 4 is a view similar to FIG. 3, showing the drum type washing machine of a second embodiment in accordance with the invention.
Figure 5:
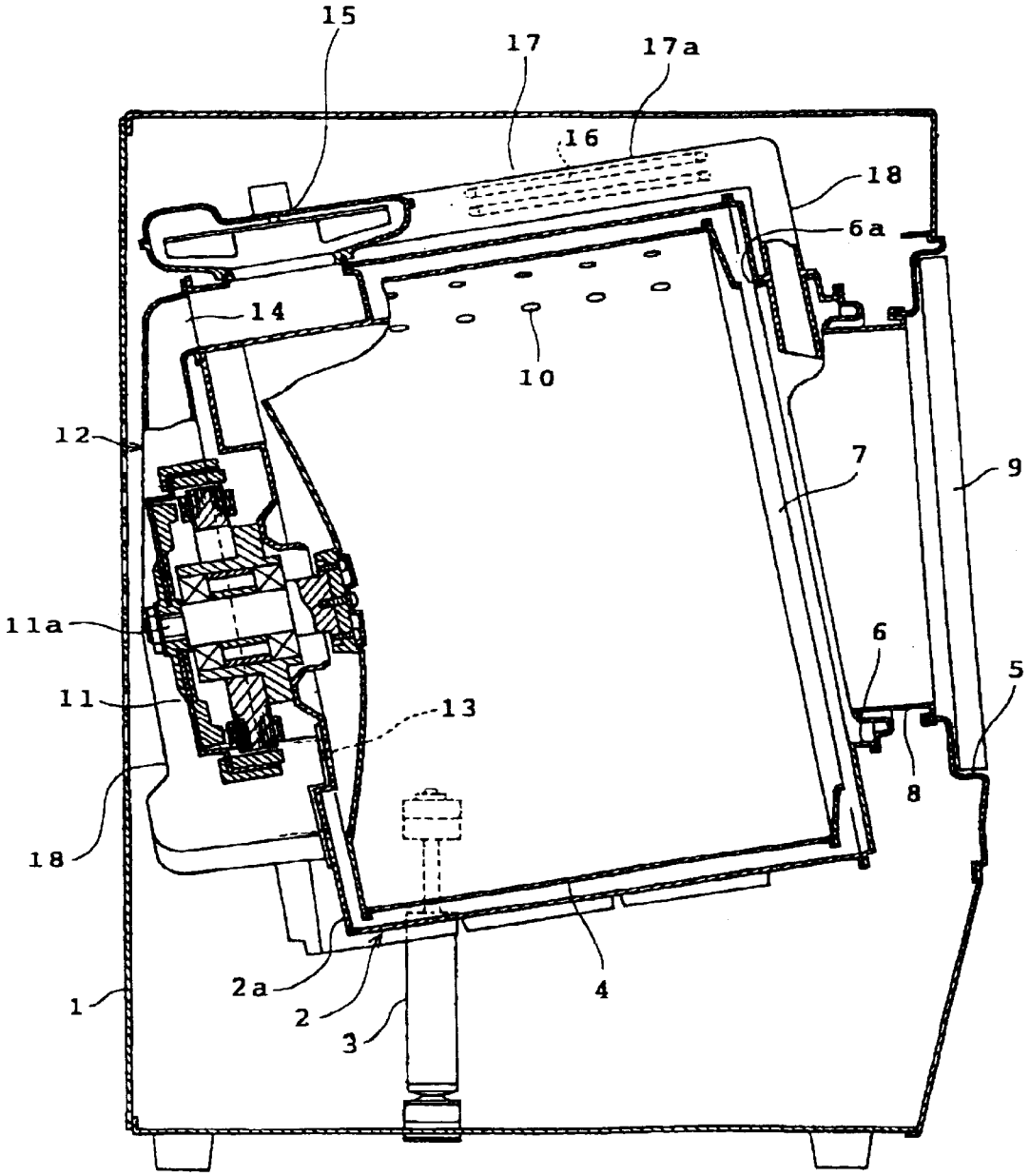
FIG. 5 PRIOR ART
FIG. 5 is a view similar to FIG. 1, showing the construction of a conventional drum type washing machine.
Figure 6:
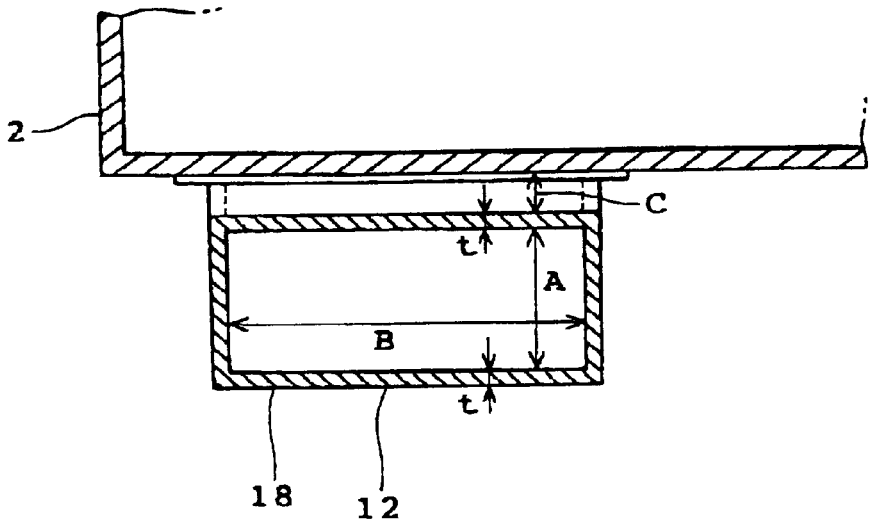
FIG. 6 PRIOR ART
FIG. 6 is a view similar to FIG. 3, showing the construction of the conventional washing machine.

FIG. 4 illustrates a second embodiment of the invention. Only the difference between the first and second embodiments will be described. Identical or similar parts in the second embodiment are labeled by the same reference numerals as those in the first embodiment. In the second embodiment, the rear panel 22*c* of the water tub 22 has an outwardly projecting convex portion 51 formed by means of press. A plate-shaped cover 52 is fixed to the inside face of the rear panel 22*c* so as to close an opening of the convex portion 51. The convex portion 51 and cover 52 constitute a part of the heat exchanger. The convex portion 51 has left-hand and right-hand side walls 51*a* and 51*b*, and a rear wall 51*c*. Thus, the heat exchanger includes a duct 53 defined by the convex portion 51 and the cover 52.

According to the above-described construction, a junction of the rear panel 22*c* and the cover 52 is located within the water tub 22. Accordingly, even when water in the duct 53 leaks out through the junction, the water is reserved in the water tub 22 and then discharged from a drain hole (not shown). Consequently, since a strict countermeasure need not be taken for water leakage at the junction, the manufacturing cost can be reduced.

In the second embodiment, no ribs are provided on the portion of the inside face of the rear panel 22*c* corresponding to the portion of the outside face thereof on which the duct 53 is disposed. The rear panel 22*c* has the convex portion 51 closed by the cover 52, whereby the rear panel can sufficiently be reinforced without ribs.

The other construction of the washing machine of the second embodiment is the same as that of the first embodiment. The same effect can be achieved from the second embodiment as from the first embodiment.

In the foregoing embodiments, the rotating tub is directly driven by the motor mounted on the rear of the water tub. For example, however, an electric motor may be provided below the water tub so that rotation thereof is transmitted via a belt drive mechanism to the rotating tub, instead.

All the ribs may be disposed on the face of the rear panel opposed to the face on which the heat exchanger is mounted, instead. Further, the rotating tub and the water tub may be disposed horizontally in the cabinet. Additionally, the heat exchanger may be provided on the circumferential wall of the water tub. In this case, a part of the duct comprises the circumferential wall.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A drum type washing machine with a drying function, comprising:

an outer cabinet;

a water tub provided in the outer cabinet and having a wall;

a generally drum-shaped rotating tub rotatably mounted in the water tub;

a driving mechanism provided on a generally central outside face of the rear wall of the water tub for driving the rotating tub; and a drying unit provided for drying laundry accommodated in the rotating tub and including a heat exchanger disposed on the rear wall of the water tub so as to be positioned around the driving mechanism, the heat exchanger having a duct provided therein so that air flows therethrough, the duct including a part comprising the rear wall of the water tub.

2. The washing machine according to claim 1, further comprising a cover mounted on an outside face of the rear wall of the water tub, wherein the duct comprises the cover as well as the rear wall of the water tub.

3. The washing machine according to claim 1, further comprising a cover mounted on an inside face of the rear wall of the water tub, wherein the duct comprises the cover as well as the rear wall of the water tub.

4. The washing machine according to claim 1, wherein the duct is mounted on the rear wall of the water tub so as to extend along a peripheral edge of the rear wall.

5. The washing machine according to claim 1, wherein the wall of the water tub comprises a rear wall, the water tub includes a number of ribs mounted on the rear wall thereof to reinforce the rear wall, and the rear wall has one of two sides on which the heat exchanger is mounted and the other side on which the ribs are mounted so as to correspond to the heat exchanger.

6. The washing machine according to claim 1, further comprising a cover mounted on the rear wall of the water tub, wherein the duct comprises the cover as well as the rear wall of the water tub, and the duct is made of a material having a smaller stiffness than the rear wall of the water tub.

7. The washing machine according to claim 6, wherein the rear wall of the water tub is made of a synthetic resin.

8. A drum type washing machine with a drying function, comprising:

an outer cabinet;

a water tub provided in the outer cabinet and having a rear wall;

a generally drum-shaped rotating tub rotatably mounted in the water tub;

an electric motor mounted on a rear wall of the water tub to directly drive the rotating tub; and a drying unit provided for drying laundry accommodated in the rotating tub and including a heat exchanger disposed on the rear wall of the water tub so as to be positioned around the motor, the heat exchanger having a duct provided therein so that air flows therethrough, the duct including a part comprising the rear wall of the water tub.

* * * * *